United States Patent [19]

Martino

[11] Patent Number: 4,902,540

[45] Date of Patent: Feb. 20, 1990

[54] MODULAR ATHLETIC TURF

[76] Inventor: Louis D. Martino, 3 Oak Hill La., Rome, Ga. 30161

[21] Appl. No.: 301,046

[22] Filed: Jan. 24, 1989

Related U.S. Application Data

[63] Continuation-in-part of Ser. No. 272,512, Nov. 17, 1988.

[51] Int. Cl.[4] ..... A63B 69/36

[52] U.S. Cl. ..... 428/17; 427/389.9; 427/394; 427/412; 428/47; 428/53; 428/62; 428/82; 428/95

[58] Field of Search ..... 428/17, 47, 53, 62, 428/82, 95; 427/389.9, 394, 412; 273/183 A, 195 R

[56] References Cited

U.S. PATENT DOCUMENTS 3,616,104 10/1971 Kuzmick ..... 428/17
3,735,988 5/1973 Palmer ..... 428/17
3,966,212 6/1976 Mason ..... 428/17

*Primary Examiner*—Marion C. McCamish
*Attorney, Agent, or Firm*—James B. Middleton

[57] ABSTRACT

Artificial athletic turf has a simulated grass surface provided by tufting strips into a backing fabric. The tufts are held in place by a precoat of polyurethane, and a reinforcing sheet is embedded within the precoat to provide tear resistance. A foamed polyurethane is placed on the precoat, and one or more reinforcing sheets are also embedded within or placed on the foamed polyurethane. The strips are hydrophobic plastic with strength to prevent damage, and the coatings are polyurethane reinforced for tear resistance, which also yields a resilience as needed for an athletic mat. One or more of the fibrous sheets may be needle felt to provide some of the needed resilience. The turf is cut along lines parallel and perpendicular to the tufting lines to provide tiles, and the tiles are assembled to form the desired turf.

9 Claims, 1 Drawing Sheet

MODULAR ATHLETIC TURF

CROSS REFERENCE TO RELATED APPLICATION

This application is a continuation-in-part of the application by the same inventor, titled "Golf Range Mat", filed Nov. 17, 1988, and assigned Ser. No. 272,512.

INFORMATION DISCLOSURE STATEMENT

Artificial athletic turf is well known and has met with substantial commercial success. One of the primary difficulties with such athletic turf is the expense. While the purchase price of artificial athletic turf is high, the major problem is the installation. To install the existing artificial athletic turf properly, heavy equipment must be used to carry and lay the heavy rolls. Additionally, each separate roll of goods must be laid and properly stretched. If the goods are not properly laid and stretched, there is a tendency for the fabric to bow, and to become biased or skewed, resulting in poor seam integrity, and possibly in puckers, gathers and folds in the body of the fabric. Some of these problems may appear for the first time long after the initial installation.

The above mentioned distortions, along with the difficulty in achieving specific adhesion to polypropylene grass yarn and scrim, will also have a long term effect on the seams, tending to cause ravelling. Therefore, the existing installation procedure requires highly skilled personnel, along with heavy equipment, which substantially increases the cost of artificial turf. Furthermore, there may still be significant problems that will become evident only after some use of the turf.

With the above mentioned problems, it will be understood that the prior art athletic turf is subject to damage under the stress of cleated shoes and the like, and the damage is especially likely at the seams of the turf where the material is already vulnerable.

SUMMARY OF THE INVENTION

This invention relates generally to athletic mats, and is more particularly concerned with a modular athletic turf having a simulated grass surface, sufficient padding to simulate normal earth, and sufficient durability to be practicable.

The present invention provides an athletic turf including a backing fabric tufted with conventional artificial grass. This fabric has a back coating of polyurethane, the polyurethane being poured onto the tufted backing to encapsulate the tufts. A fibrous sheet is embedded in the polyurethane to provide tear resistance, and additional strength and integrity to the coating. Before the polyurethane coating is fully cured, a second, frothed, polyurethane mixture is placed on the backing to provide a foamed padding. A fibrous reinforcing sheet may be embedded in the foamed polyurethane to provide additional tear resistance.

In the preferred embodiment, the turf is cut into squares, or tiles, so an athletic playing field can be covered by placing individual tiles throughout the field. A permanent or take-up adhesive may or may not be used to assist in retaining the tiles in place.

BRIEF DESCRIPTION OF THE DRAWINGS

These and other features and advantages of the present invention will become apparent from consideration of the following specification, when taken in conjunction with the accompanying drawings in which.

DETAILED DESCRIPTION OF THE EMBODIMENT

Figure 1:
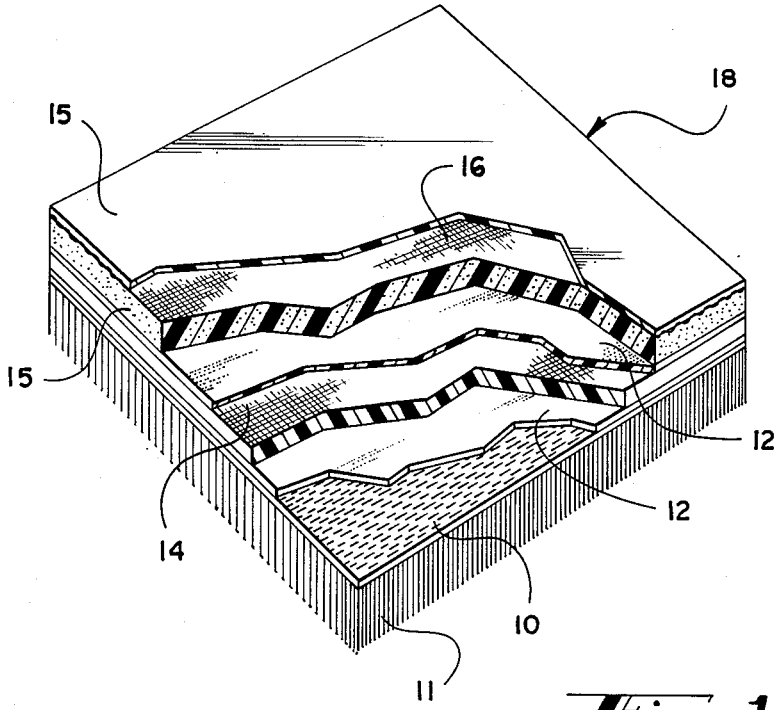
FIG. 1 is a perspective view of a single tile made in accordance with the present invention, portions thereof being broken away to reveal the entire construction; and, FIG. 2 is a perspective view on a reduced scale showing a plurality of tiles for forming an athletic turf in accordance with the present invention.

Referring now more particularly to the drawings, and to that embodiment of the invention here presented by way of illustration, the single tile shown in FIG. 1 includes a conventional carpet backing designated at 10 having synthetic grass 11 tufted therein. Those skilled in the art will understand that the backing 10 may be any of numerous backing materials, one of the more common being a woven polypropylene fabric or fabrics which may or may not include a staple fiber needlepunched into the backing fabric. This fabric or numerous other conventional backing fabrics can be used as desired.

The simulated grass 11 is most commonly made of thin sheets of polypropylene that are longitudinally slit to provide strips simulating blades of grass. Again, polypropylene works quite well, but other materials such as nylon and polyester are also useful. One must simply remember that the material is to be used outdoors so that it must normally be hydrophobic, and the material will receive large shear forces so that the material must be rather tough.

After a backing material has been tufted, it is conventional to coat the back of the material with an adhesive substance to lock in the tufts. Prior art efforts at making athletic turf have included the use of a polyurethane to provide tuft lock, but these past efforts have not met with complete success. One of the primary difficulties is that polyurethane, and most of the other adhesives utilized, are polar substances while polypropylene is a non-polar substance; thus, there is simply little to no specific adhesion between the adhesive and the polypropylene. Additionally, much of the problem in athletic turf is not due to the normal delamination caused by lack of adhesion, deterioration through hydrolysis and the like, but is caused by literally tearing the turf due to the high shear forces, and especially at the seams. When the turf is so torn, the polyurethane may or may not be forcibly pulled from the tufted carpet.

The present invention resolves the above mentioned difficulties first by pouring a liquid polyurethane mix onto the back of the tufted carpet, which is to say onto the backing 10. The viscosity of the polyurethane mix is such that the mixture will somewhat flow through the backing 10 so the tufts of grass 11 are totally encapsulated in the vicinity of the backing 10. While there may be no specific adhesion between the polyurethane and the polypropylene, the fact that the individual tufts are completely surrounded with the polyurethane provides an excellent lock for the tufts.

In FIG. 1, the polyurethane coat is designated at 12; and, it will be seen that there is a fibrous sheet 14 between two layers designated at 12. It will be understood that the drawing is somewhat schematic, and the fibrous sheet 14 represents a reinforcing sheet completely embedded in the polyurethane 12.

If the sheet 14 is not sufficiently permeable, one might place a first coating of polyurethane against the backing 10, then place the sheet 14, and lay another coat of polyurethane 12. On the other hand, with some knit or open weave sheets 14 that are sufficiently permeable, the sheet 14 may be placed into the polyurethane mixture and the sheet 14 will become embedded in the mixture 12. Additionally, multiple reinforcing sheets and polyurethane precoats may be used. Again, one or more reinforcing sheets may be used, comprising woven or nonwoven fabrics, woven paper yarn or nonwoven paper, and/or needle felts with or without reinforcing scrims. When needle felts are used as primary or secondary fabrics, the felt provides a considerable amount of cushioning for the turf. Additionally, when a needle felt is used as the primary backing fabric, it will minimize the quantity of the polyurethane coating required and prevent polyurethane bleedthrough to the face of the turf.

It is well known that, in conventional carpeting, one is normally concerned that the polyurethane coating will bleed through the backing 10 and be visible from the face side of the carpet. In the present invention, some such spike through will be desirable in order to encapsulate the tufts fully. Nevertheless, extremes must still be avoided since the surface should simulate grass as nearly as possible.

Before the polyurethane coating 12 has fully cured, a second coating designated at 15 is applied. As before, the coating 15 is shown in two layers separated by a fibrous material 16.

It will be noted that the coating 15 is indicated as foamed. The coating 15 is also a polyurethane, but the coating 15 is foamed, or frothed, to provide the desired cushioning effect.

Those skilled in the art will understand that polyurethane mixtures are foamed in several different ways. The most commonly used technique for carpet padding and the like is to add water to the polyurethane mixture, the water reacting with the isocyanate to produce gas for blowing the mixture. Flourinated hydrocarbons are also used fairly frequently, the heat of reaction of the polyurethane causing the flourinated hydrocarbon to boil and yield the gas for blowing the material. A third technique is to froth the material mechanically to provide a sufficient inclusion of air to yield the foam density desired. While any of these techniques might be used, it is contemplated that the mechanical frothing technique will be used in view of the relatively high density desired. Whereas a conventional carpet backing might have a density in the vicinity of two to three pounds per cubic foot, the padding for use in the present invention should have a density in the general range of 15 to 50 pounds per cubic foot.

After the polyurethane material has been frothed, it will be laid on the coating 12. As before, the reinforcing sheet 16 might be placed between two coatings of polyurethane material 15, or it might be placed into or onto the one coating while the coating is substantially fluid.

As has been mentioned above, the polyurethane coatings 12 and 15 are generally conventional polyurethanes, and those skilled in the art will readily devise numerous workable formulations. By way of example, the following formulation has been successfully used as the coating 12:

| Item | Parts by Weight |
|---|---|
| Polypropylene Glycol (average molecular weight 3,000–5,000) | 80.0 |
| Reinforcing Polyol | 20.0 |
| Catalyst | 0.5 |
| Pigment | 2.0 |
| Mineral Filler (clay, aluminum trihydrate etc.) | 50.0 |
| Moisture Scavanger | 2.0 |
| Diphenyl Methane Di-isocyanate | 34.7 |

The foamed polyurethane 15 has been made with exactly the same formulation, but with the addition of 3.0 parts of a silicone surfactant to facilitate the frothing of the material.

With the above description in mind, it should be understood that the reinforcing sheets 14 and 16 can take almost any form, including knit fabrics, non-woven fabrics, woven fabrics of either a tight weave or a very loose weave or the like. The reinforcing sheets may be polyester, fiberglass, nylon or other materials with reasonably high strength, and including paper sheets. Thus, it must be realized that the reinforcing sheets 14 and 16 are not for the purpose of lending dimensional stability to the mat, but to provide tear resistance. As was mentioned above, it has been found that the primary problem in destruction of the athletic turf is the tearing of the material, and mostly at the seams. The tearing may appear to be delamination of a cushion from a tufted fabric, but the tearing is the initial problem, and the delamination tends to be more of a symptom. Thus, by providing sufficient tear resistance the mat will have greater durability, and delamination is no longer a problem.

The present invention further provides two urethane coatings that are poured on in liquid form and cure in place. As is well known to those skilled in the art, if the second coating 15 is placed on the first coating 12 before the coating 12 is fully cured, there will be an intimate bond between the two coatings so that delamination is virtually impossible. It has been mentioned that the polyurethane precoat 12 will not adhere to the polypropylene grass 11 or the polypropylene primary backing 10; however, the polypropylene grass and the polypropylene primary backing are encapsulated by the polyurethane sufficiently that the entire mat will stay together.

It will therefore be seen that the present invention provides an athletic mat having a grass-like surface that is well locked into the backing through the encapsulation in the polyurethane. The polyurethane coating 12 provides toughness along with some resilience, and the foamed polyurethane coating 15 provides the desired resilience. The reinforcing fabrics 14 and 16 render the mat highly tear resistant which resolves most of the difficulties in rapid destruction by the high shear stresses to which the turf may be subjected.

Figure 2:
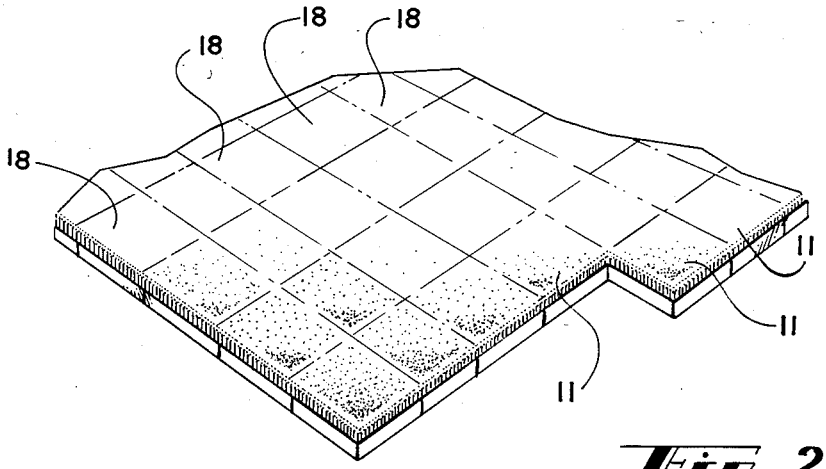

With the above described construction in mind, attention is directed to FIG. 2 of the drawings which illustrates a plurality of individual tiles, or squares, assembled to form an athletic turf. The primary feature of the turf illustrated in FIG. 2 is the fact that the turf is modular, which is to say that a plurality of individual squares is assembled to make up the solid carpet desired. It should be noted that the terms "tiles" and "squares" are here considered to be interchangeable, since the important feature is the relatively small piece of carpet, and not the shape. The tiles may be square, rectangular, or other polygonal shape that will fit together to form a solid carpet.

In providing the modular athletic turf illustrated in FIG. 2, there are several particular concerns to be addressed. As is stated above, the primary problem in the prior art athletic turf is the damage at the seams of the material. Since the modular turf has a very large number of junctions, one might expect an even greater problem. To the contrary, however, the seams constitute no problem in the turf of the present invention.

First, it must be understood that the individual tiles of the present invention are formed by tufting a standard width material, such as six-, twelve- or fifteen-foot widths. The wide carpet is coated with the backings 12 and 15; then the carpet is cut into the pieces constituting the tiles 18. The cutting technique may be substantially the same as is used for conventional carpet tiles, and by way of example may be through the use of a steel rule die, machine die, reciprocating knife, circular knife or water jet. In cutting squares, the cuts will be made along lines generally parallel to the rows of tufts, and generally perpendicular thereto.

Realizing that the usual tufted carpet for use as athletic turf is small gauge, it will be recognized that the tufts will not be far from a cut regardless of the care exercised in making the cut. For this reason, the particular coating of the tufted material is important. First, the precoat 12 is applied to the tufted fabric in such manner that the polyurethane completely encapsulates each tuft. This encapsulation locks the tufts to the backing, and thereby assists in preventing ravelling at the edges of the tiles. Next, both the layers 12 and 15 contain fibrous sheets to reinforce the polyurethane. Since the primary difficulty in the prior art athletic turf is degradation of the material at the seams, the presence of the fibrous sheets significantly improves the turf of the present invention. Remembering the technique of construction discussed above, it will be recalled that the fibrous sheets 14 and 16 are totally immersed in the liquid mix for the polyurethane, so the fibrous sheets 14 and 16 are completely saturated with the mix. As the liquid mix cures, the fibrous sheets 14 and 16 will be encapsulated in the polyurethane to prevent ravelling of the sheet and, reciprocally to reinforce the polyurethane backing.

In installing the turf of the present invention, it is possible that the individual squares 18 may be put into place relying on the close fit to retain the desired positions. Because of the durability of the tiles, the close fit contemplated, and the weight of the tiles, such installation can be quite satisfactory. If more is needed because of great stresses on the turf, it is contemplated that a pressure sensitive or permanent adhesive will be used. If a pressure sensitive or take-up adhesive is used, it will still allow the removal and/or replacement of While the grass surface 11 might be polypropylene or nylon as is conventional, it is also contemplated that other materials can be used, either alone or in combination. For example, a polyester yarn run parallel with a polypropylene yarn, and the pair texturized, or twisted together, or twisted together and texturized, will provide a yarn of greater bulk as well as a more carpetlike appearance. The particular yarn, and yarn density, can be varied to suit the particular use intended, and to withstand the stresses contemplated. Thus, the present invention provides a turf and/or a turf tile that simulates a grass covered earth field, and can therefore be used in virtually any sport or the like where grassy turf is desired.

It will therefore be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. Modular athletic turf comprising a plurality of polygonal tiles, each tile of said plurality of tiles having a simulated grass surface and padding to simulate earth, said tile including a backing fabric, tufts in said backing fabric to simulate grass, a first coating on said backing fabric for locking said tufts in said backing fabric, a second coating formed on said first coating and adhered thereto, and a plurality of fibrous sheets within said first coating and said second coating, said plurality of fibrous sheets extending parallel to said backing fabric, said first coating comprising a cured in place polyurethane, one of said plurality of fibrous sheets being embedded within said first coating, said second coating comprising a foamed polyurethane adhered to said first coating, and another of said plurality of fibrous sheets being embedded within said second coating, said tufts in said backing fabric consisting of strips of material simulating grass, said first coating encapsulating said tufts to hold said tufts to said backing fabric.

2. A modular athletic turf, said turf including a backing fabric, strips of material tufted into said backing fabric along tufting lines for simulating grass, a first coating on said backing fabric for locking the tufts in said backing fabric and securing said strips of material in said backing fabric, a fibrous sheet embedded within said first coating, said fibrous sheet being parallel to said backing fabric, and a second coating fixed to said first coating, said second coating comprising a foamed elastomeric material for providing a cushion for said turf, said turf being cut into a plurality of tiles and placed together contiguously for forming said athletic turf.

3. A modular athletic turf as claimed in claim 2, said first coating comprising a polyurethane, said second coating comprising a foamed polyurethane, and further including a second fibrous sheet embedded within said second coating, said second fibrous sheet being parallel to said backing fabric.

4. A modular athletic turf as claimed in claim 3, said strips of material comprising a material selected from the group consisting of polypropylene, nylon, and polyester, and mixtures thereof.

5. A modular athletic turf as claimed in claim 4, wherein the edges of said tiles are generally parallel and perpendicular to said tufting lines.

6. A modular athletic turf as claimed in claim 5, wherein at least one of said fibrous sheets consists of a needle felt.

7. A method for making a modular athletic turf comprising a simulated grass surface and padding to simulate earth, said method including the steps of tufting a backing fabric along tufting lines with strips to simulate grass, pouring a polyurethane mix onto the back of said backing fabric and allowing said polyurethane mix to encapsulate said strips tufted into said backing fabric and to react, preparing a second polyurethane mix and frothing said second polyurethane mix, pouring said second polyurethane onto the partially cured polyurethane mix and allowing both said polyurethanes to cure, and including the steps of placing a fibrous sheet in at least one of said polyurethane mixes prior to the step of allowing said polyurethanes to cure, and cutting said backing fabric into a plurality of polygonal tiles.

8. A method as claimed in claim 7, wherein the step of placing a fibrous sheet in at least one of said polyurethane mixes includes placing a fibrous sheet on said second polyurethane mix, and allowing said fibrous sheet to become attached to said second mix.

9. A method as claimed in claim 7, wherein the said step of cutting said backing fabric into a plurality of polygonal tiles includes cutting said backing fabric along lines generally parallel and perpendicular to said tufting lines.

* * * * *